US009109854B1

(12) United States Patent
Mazzaccaro

(10) Patent No.: US 9,109,854 B1
(45) Date of Patent: Aug. 18, 2015

(54) COMB FOR RECOIL OF SHOULDER FIRED WEAPON

(71) Applicant: John Mazzaccaro, Manchester, NJ (US)

(72) Inventor: John Mazzaccaro, Manchester, NJ (US)

( * ) Notice: Subject to any disclaimer, the term of this patent is extended or adjusted under 35 U.S.C. 154(b) by 6 days.

(21) Appl. No.: 14/120,076

(22) Filed: Apr. 24, 2014

(51) Int. Cl.
*F41C 23/14* (2006.01)
*F41C 23/06* (2006.01)

(52) U.S. Cl.
CPC ..... *F41C 23/06* (2013.01); *F41C 23/14* (2013.01)

(58) Field of Classification Search
CPC ..... F41C 23/00; F41C 23/04; F41C 23/14; F41C 23/18
USPC ..... 42/71.01, 72, 73, 74, 90
See application file for complete search history.

(56) References Cited

U.S. PATENT DOCUMENTS

| | | | | | |
|---|---|---|---|---|---|
| 2,100,514 | A | * | 11/1937 | Miller et al. | 42/71.01 |
| 2,669,051 | A | * | 2/1954 | Cline | 42/71.01 |
| 3,710,496 | A | * | 1/1973 | Packmayr et al. | 42/71.01 |
| 4,055,016 | A | * | 10/1977 | Katsenes | 42/71.01 |
| 4,589,219 | A | * | 5/1986 | Milliman | 42/73 |
| 4,663,877 | A | * | 5/1987 | Bragg | 42/74 |
| 4,896,446 | A | * | 1/1990 | Gregory | 42/73 |
| 5,031,348 | A | * | 7/1991 | Carey | 42/74 |
| 5,235,764 | A | * | 8/1993 | Perazzi | 42/73 |
| 5,392,553 | A | * | 2/1995 | Carey | 42/73 |
| 5,519,957 | A | * | 5/1996 | Iannetta | 42/74 |
| 5,933,997 | A | * | 8/1999 | Barrett | 42/73 |
| 6,032,397 | A | * | 3/2000 | Iannetta | 42/73 |
| 2003/0154640 | A1 | * | 8/2003 | Bragg | 42/74 |

* cited by examiner

*Primary Examiner* — Jonathan C Weber
(74) *Attorney, Agent, or Firm* — Clifford G. Frayne

(57) ABSTRACT

A comb and mounting mechanism for a shoulder fired weapon, wherein the mounting mechanism isolates the comb from the recoil of the shoulder fired weapon, the comb being a piece of the original stock of the shoulder fired weapon along the upper ridge, which is removed from the weapon.

14 Claims, 8 Drawing Sheets

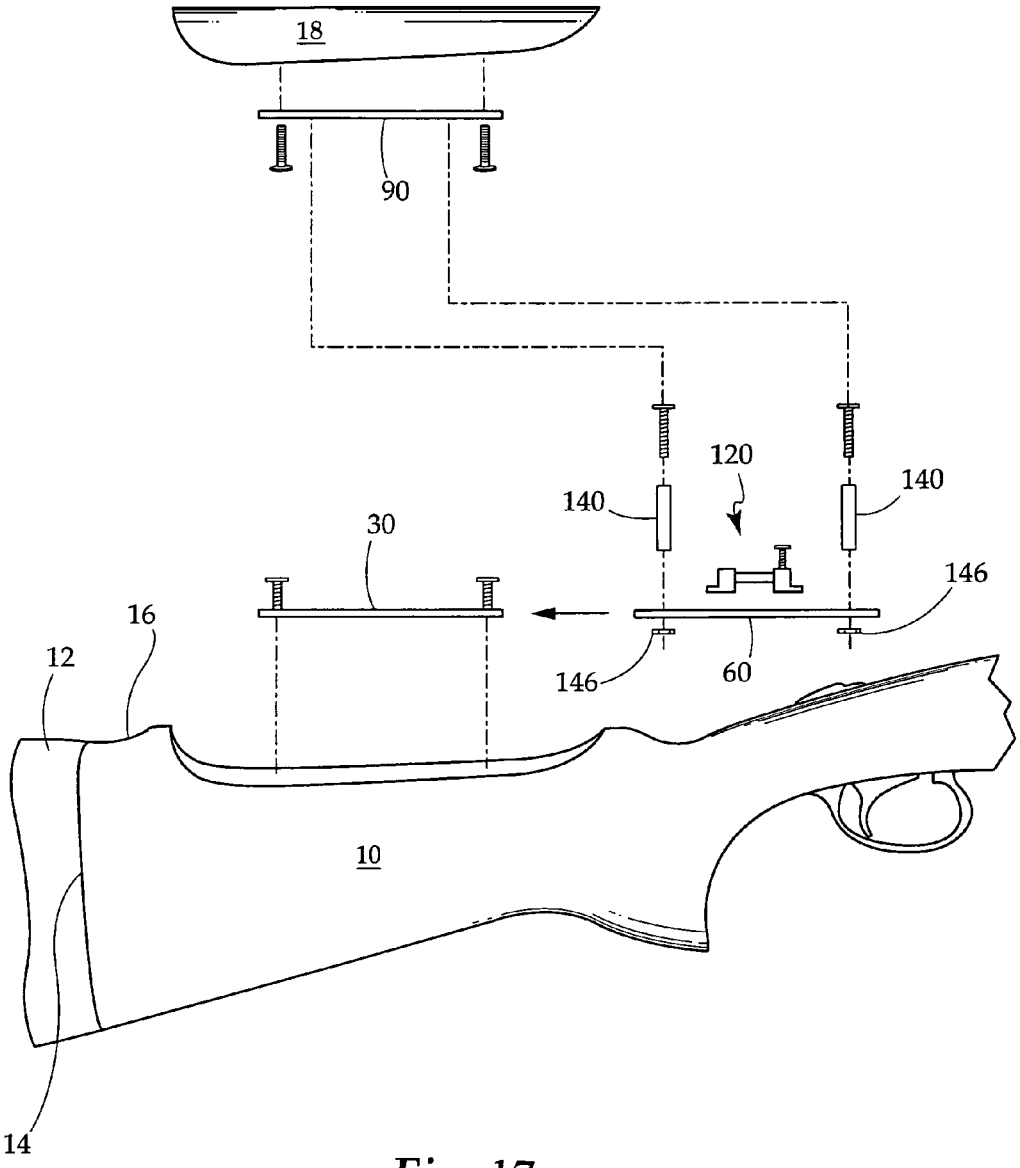
*Fig.* 17

COMB FOR RECOIL OF SHOULDER FIRED WEAPON

RELATED APPLICATIONS

Applicant claims the benefit of provisional application Ser. No. 61/966,470, filed Feb. 24, 2014.

BACKGROUND OF THE INVENTION

1. Field of the Invention

The present invention relates to shoulder fired weapons which generate a recoil against the individual's shoulder, and more particularly to an improved comb mounted to the stock of such shoulder fired weapon, the improved comb isolating the comb from the recoil of the shoulder fired weapon and maintaining contact with the cheek of the shooter.

2. Description of the Prior Art

Shoulder fired weapons that generate recoil typically fall into the category of rifles and shotguns. These two types of shoulder fired weapons consist of a myriad of parts and elements, but can be broken down into three main groups, the barrel, the breech where the ammunition is loaded and ignited, and the stock which rests against the individual's shoulder and on which the individual normally rests his cheek in order to utilize the aiming devices of the shoulder fired weapon, which are normally positioned approximate the breech and the barrel opening.

The action of the firing pin upon the bullet or the shot shells, depending upon whether one is firing a rifle or a shotgun, ignites the powder charge within the bullet or shot shell, the expansion of gases rapidly expanding down the barrel of the shoulder fired weapon, and accelerating the bullet in the case of a rifle, or the contents of the shot shell. This rapid expansion of the gases is what causes the shoulder fired weapon to recoil against the shoulder of the user.

The recoil has a deleterious affect on the shooter, both psychologically and physically. Physically, the recoil repeatedly slams the stock into the shoulder of the individual. It also causes a rubbing motion on the cheek of the individual where the cheek contacts the top portion of the stock for aiming. Over time this can actually generate a bruising on the cheek of the individual, not to mention the shoulder of the individual. The anticipation of the recoil also affects the shooter psychologically in that he knows the recoil is coming and might flinch or try to anticipate it before it actually occurs, thus destroying his aim, and his accuracy. This is of particular importance with respect to shotguns in that two very popular sports are shooting skeet and traps, which require extreme accuracy on the part of the shooter, good reflexes, and the ability to get off multiple shots within a very short period of time while maintaining accuracy. This is particularly important to shotgun shooters when they are shooting doubles, which involves the simultaneous release of two sporting clays which the shooter must engage with two substantially simultaneous shots.

There have been many attempts to reduce the recoil effect. In the trade, these attempts are often referred to as backboring, forcing cone work and ported barrels. None of these have had a significant affect on the reduction in recoil. Similarly, a shooter can affect the recoil by the load of powder in the shot shells which he uses, but this will not totally eliminate recoil. Additionally, the weight of the shotgun can be adjusted by the shooter. A heavier gun having better recoil characteristics than a much lighter gun if both are fired with the same shot shell. Also, the velocity of the load traveling down the bore of the barrel can be adjusted to reduce its foot per second velocity, and thus the recoil. However, such reduction must be measured against the type of shooting which is being done, and the desire to hit a target at a required distance.

In addition to making adjustments to the ammunition and/or the weapon, another recoil solution has been to design elaborate shock absorber systems which are positioned within the stock and inserted from the blunt end of the stock which contacts the shooter's shoulders. These shock absorber mechanisms are extremely expensive and require an extensive amount of work on the stock, the stock sometimes being from exotic woods and being measured in terms of thousands of dollars in value. These mechanical shock absorber mechanisms have been successful in reducing recoil somewhat, but not entirely, and at a cost of substantial work and expense on the gun itself.

Applicant has developed an improved comb for shoulder fired weapons which generate recoil. The improved comb does not attempt to deal with the recoil problem, however, psychologically and physically, it provides the shooter with a much more comfortable feel to the weapon during the firing of the weapon.

Applicant's improved comb utilizes a mounting system on the stock of the weapon in which the comb is secured to the upper ridge of the stock by a series of plates and posts which allows the shooter to adjust the comb upwardly from the stock and to the left and to the right so that the shooter can find a comfortable position to place his cheek when aiming and firing the weapon. This adjustment of the comb compensates for the physiologic attributes of different individuals based on the length of their necks, the size of their heads, the width of their heads, etc. Additionally, Applicant's improved comb is biasly mounted so that it is independent of the recoil of the shoulder fired weapon. Therefore the shooter with his cheek pressed against Applicant's improved comb may fire the weapon, and experience the recoil of the weapon against the shooter's shoulder, but the recoil will not affect the cheek of the shooter and thus not bruise the shooter. This contributes to the shooter's comfort with the weapon during aiming and firing and reducing the physical response of the shooter possibly flinching or moving his head during the firing exercise in anticipation of the frictional bruise which would be applied with a normal comb.

OBJECTS OF THE INVENTION

An object of the present invention to provide for a novel and improved comb for a shoulder fired weapon, the comb and its mounting mechanism isolating the comb from the recoil of the shoulder fired weapon.

A still further object of the present invention to provide for a novel comb and mounting mechanism for a shoulder fired weapon which allows the comb to be adjusted upwardly, downwardly, and from right to left to match the physiologic attributes of the shooter.

A further object of the present invention is to provide for a novel improved comb and mounting mechanism wherein the mechanism itself is biasly mounted to the stock to isolate the comb from the recoil of the shoulder fired weapon.

A further object of the invention to provide for a novel improved comb and mounting system for a shoulder fired weapon wherein the novel mounting system can fit the stock of a variety of shoulder fired weapons.

A still further object of the present invention is to provide for a novel improved comb and mounting assembly which isolates the comb from the recoil of the shoulder fired weapon, the shoulder fired weapon being specifically a shotgun.

A still further object of the present invention is to provide for a novel comb and mounting mechanism for a shoulder fired weapon which isolates the comb from the recoil of the shoulder fired weapon wherein the shoulder fired weapon is a rifle.

A still further object of the present invention is to provide for a novel improved comb and mounting assembly which allows the shooter to adjust the tension and compression of the biasing means.

SUMMARY OF THE INVENTION

A comb and mounting mechanism for a shoulder fired weapon, wherein the mounting mechanism isolates the comb from the recoil of the shoulder fired weapon, the comb being a piece of the original stock of the shoulder fired weapon along the upper ridge which is removed from the weapon, the mounting mechanism being a mounting plate secured to the underside of the comb, and a second mounting plate secured to the stock at a location where the comb was removed, the two mounting plates being in complimentary alignment, the upper mounting plate mounted to the underside of the comb, having a pair of spaced apart transverse slots perpendicular to the longitudinal direction of the upper mounting plate, the spaced apart transverse slots cooperating with upstanding posts in the lower mounting plate, to permit left to right adjustment of the comb for contact with the cheek of the shooter, the lower mounting plate having two upstanding posts cooperative with the transverse slots of the upper mounting plate, these posts adjustable by a pair of set screws, and a biasing means positioned in the lower mounting plate, the biasing means being a spring which allows for the recoil of the shoulder fired weapon and the stock, but isolates the upper mounting plate and the comb from such recoil, thereby eliminating bruising to the cheek of the shooter, and includes bias adjustment depending upon type of ammunition and preference of shooter.

BRIEF DESCRIPTION OF THE DRAWINGS

These and other objects of the present invention will become apparent, particularly when taken in light of the following illustrations wherein:

FIG. 17 is a perspective exploded view of the improved comb and mounting mechanism with respect to the stock of the shoulder fired weapon.

DETAILED DESCRIPTION OF THE INVENTION

Figure 1:
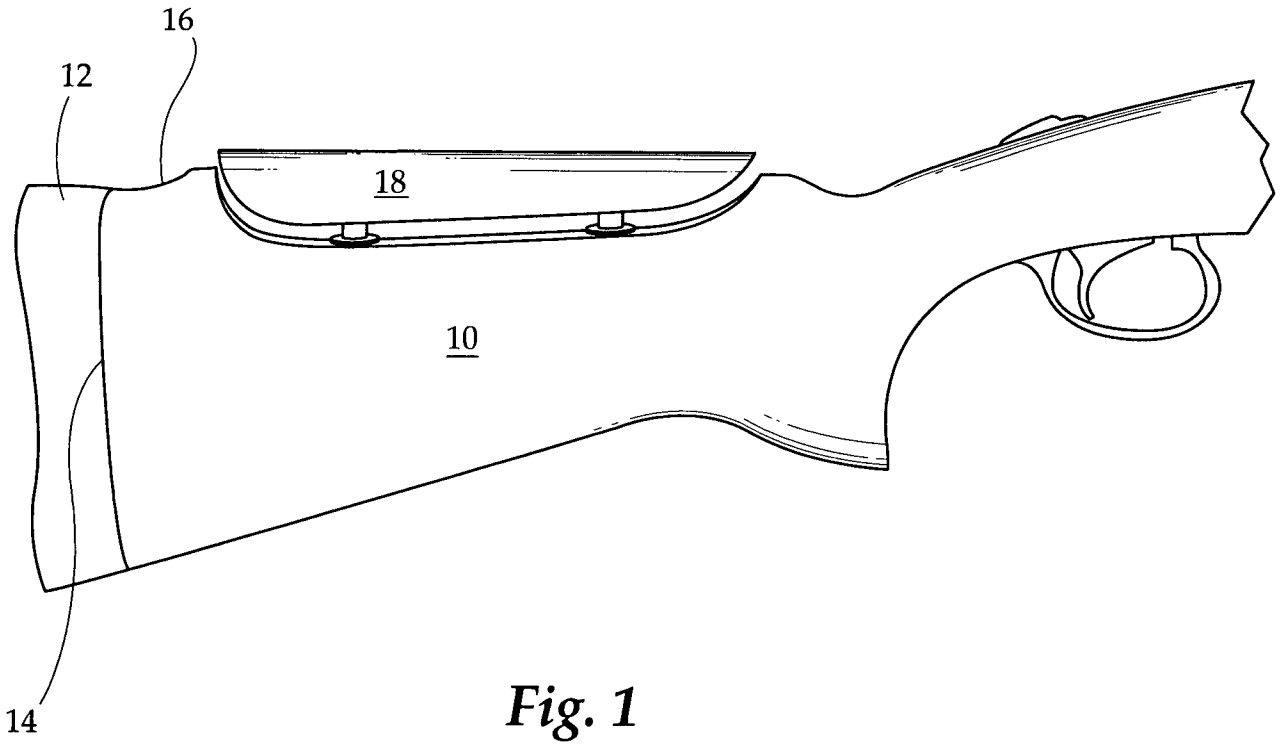
FIG. 1 is a perspective view of the stock and comb of a typical arrangement for a shoulder fired weapon in the form of a shotgun.

FIG. 1 is a perspective view of a typical stock and comb assembly of a shoulder fired weapon in the form of a shotgun. The stock 10 is illustrated with a recoil pad 12 secured to the butt 14. The stock 10 is normally made of wood, although other materials can be used. The use of wood enhances the value of the weapon from an aesthetic point of view, because in many cases, exotic woods are utilized to form the stock 10 and are highly treated and finished to bring out the grain of the underlying wood.

The comb 18 is actually cut from the original stock 10. It is cut from the upper ridge 16 of the stock where the shooter would normally rest his cheek in aiming and firing the weapon. With or without the comb 18, the shooter's cheek is subjected to the recoil of the shotgun against the shooter's shoulder and the ridge of the stock frictionally engages the cheek of the shooter.

The physiological aspects of an individual's head and face, neck and shoulder are not all identical. Therefore unless the stock of the weapon was measured specifically for an individual, the individual firing the weapon may find it uncomfortable in positioning his cheek on the stock of the shotgun when firing. This has led to the development of the comb 18. The comb 18 was originally designed to lift and adjust the contact point of the stock and the individual shooter's cheek to compensate for the physiological aspects of a particular shooter. The original combs were adjustable up and down and right to left by a few centimeters in order to compensate for the physiological differences. The comb 18 would be cut from the original stock 10, the unpolished lower surface 20 of the comb 18, and the cutout portion of the stock 22 would then be polished, and a mounting mechanism would be installed on the underside 20 of the comb 18 and on the cutout portion 22 of the stock 10.

The two complimentary mounting mechanisms or plates would then be secured to each other and adjustable by a series of set screws and upstanding posts. In this regard, the shooter can adjust the comb 18 to his personal physiological aspects in order to find a comfortable position for firing the weapon. This is of particular importance with respect to shotguns when shooting skeet and trap, and sporting clays, and in particular, shooting doubles, in that the shooter fires consecutively at multiple targets using multiple shots and may in the course of an afternoon shoot several hundred rounds of shot. This comb 18 with each shot provides some psychological benefit to the shooter in that he realizes he is in a comfortable position with respect to his shoulder, neck, and cheek in the multiple firing of the weapon. The one thing that the comb of the prior art did not address and did not solve was the bruising to the shooter's cheek because of the great variety of shots required during the course of the skeet or trap shoot and the continuous recoil of the weapon, shot after shot, against the individual's cheek, causing bruising in some instances. This has a psychological affect on the shooter in that he anticipates the recoil against his cheek and may flinch, thus affecting his aim, accuracy, and score.

Figure 2:
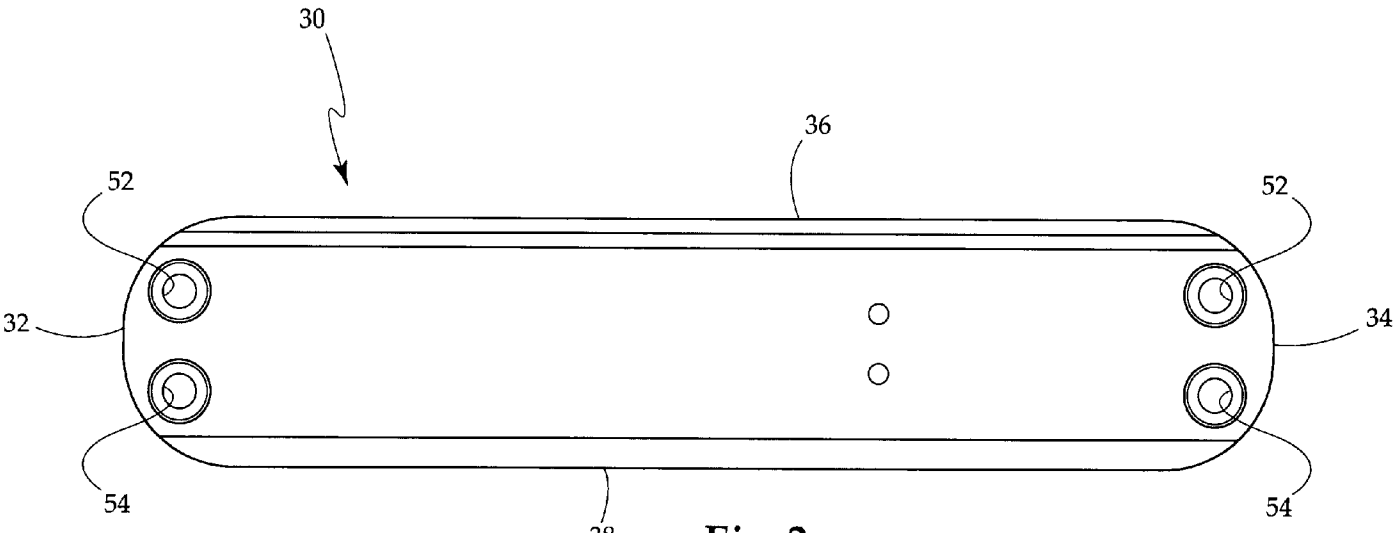
FIG. 2 is a top view of the first mounting base plate which would be mounted to the stock of the weapon.
Figure 3:
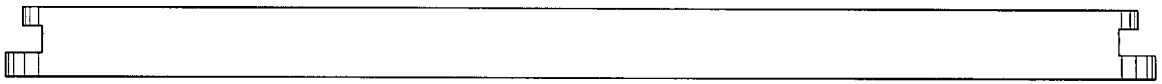
FIG. 3 is a side view of the first mounting plate secured to the stock of the weapon.
Figure 4:
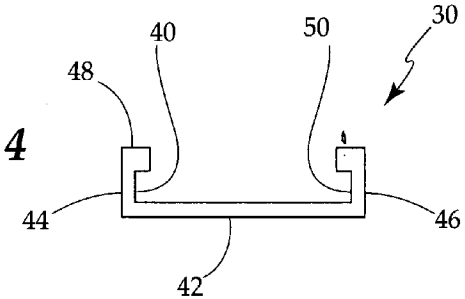
FIG. 4 is an end view of the first mounting plate secured to the stock of the weapon.

FIG. 2 is a top view of a first mounting plate 30 secured to the stock 10 of a shoulder fired weapon. First mounting plate 30 is elongate in nature having ends 32 and 34, and longitudinal edges 36 and 38. FIG. 3 is a side view of the first mounting plate 30 and FIG. 4 is an end view of first mounting plate 30. It can be seen the first mounting plate 30 is formed with a slot 40 defined by its planar base element 42, side walls 44 and 46, and internal flanges 48 and 50. First mounting plate 30 is also formed with apertures 52 and 54 proximate the ends 32 and 34 for securing first mounting plate 30 to the stock 10 of the shoulder fired weapon.

Figure 5:
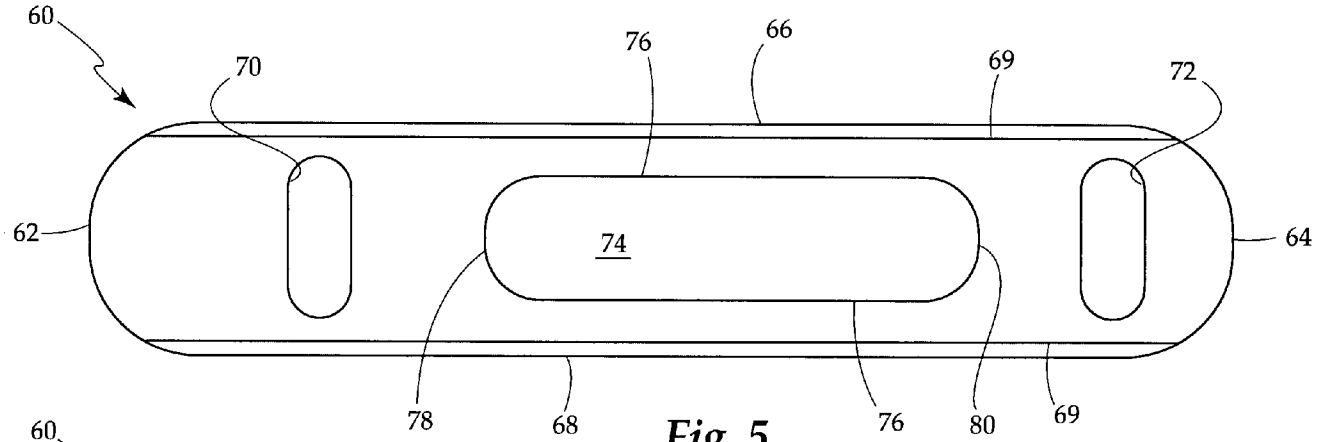
FIG. 5 is a top view of the second mounting plate which interacts with the first mounting plate secured to the stock of the weapon.

Slidably secured to first mounting plate 30 is a second mounting plate 60 (FIG. 5). Second mounting plate 60 is complimentary in shape with first mounting plate 30 having ends 62 and 64 and longitudinal edges 66 and 68. Second mounting plate 60 is stepped 69 along its longitudinal edges to form a lower planar base member having a thickness allowing it to be slidably received within slot 40 in lower mounting plate 30. Second mounting plate 60 further has two slots 70 and 72 proximate the ends 62 and 64, slots 70 and 72 being perpendicular to the longitudinal axis of second mounting plate 60, and being countersunk to accommodate a friction securing nut for a post as described hereafter. There is also an aperture 74, having longitudinal edges 76 and rounded ends 78 and 80 formed centrally on the base of second mounting plate 60. Aperture 74 is for receipt of the biasing means which isolates the comb 18 from the recoil of the shoulder fired weapon and the slots 70 and 72 are formed to cooperate with posts as more fully described hereafter to allow the adjustment of the comb 18 in a left to right orientation to accommodate the physiologic aspects of the individual shooter.

Figure 6:
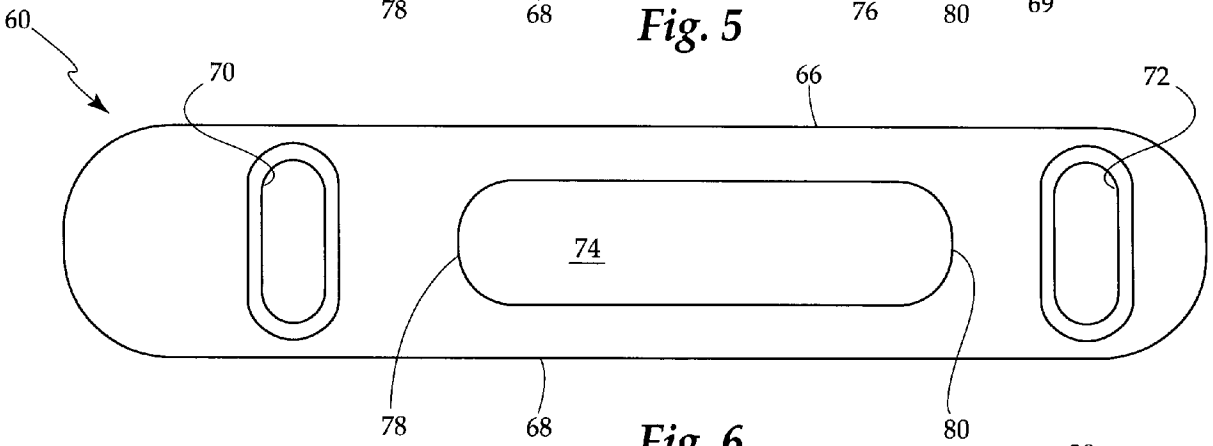
FIG. 6 is a bottom view of the second mounting plate secured to the first mounting plate and to the stock of the weapon.
Figure 7:
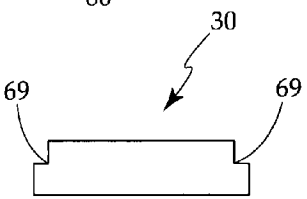
FIG. 7 is an end view of the second mounting plate secured to the first mounting plate, which in turn is secured to the stock of the weapon.

FIGS. 6 and 7 are bottom views and end views of the second mounting plate.

Figure 8:
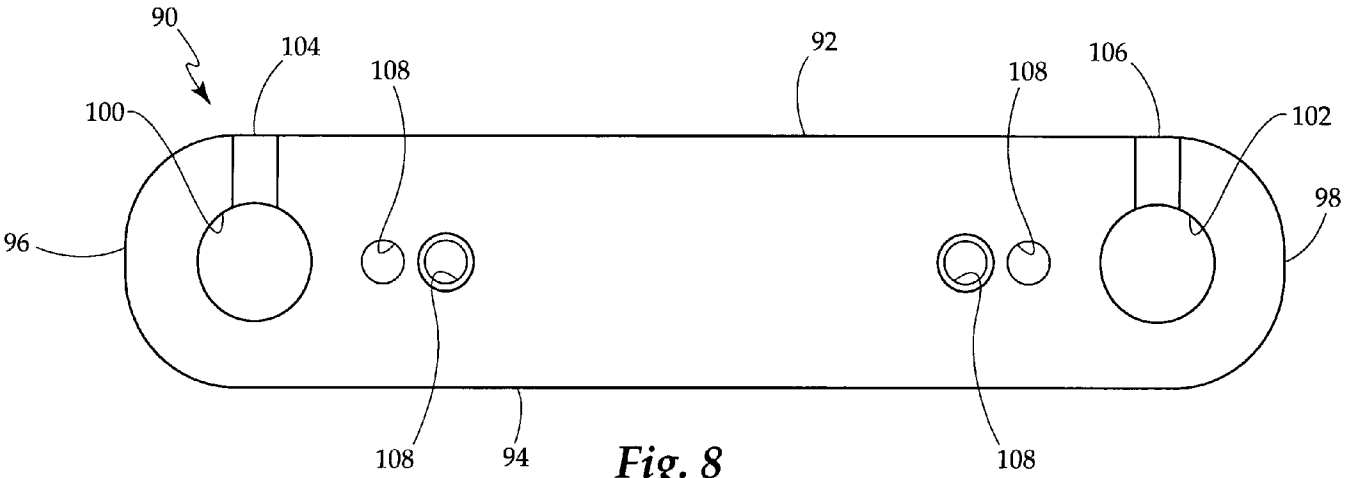
FIG. 8 is a top view of the third mounting plate which is secured to the lower surface of the comb.

FIG. 8 is a top view of a third mounting plate 90 which is secured to the lower surface 20 of comb 18. Third mounting plate 90 is complimentary with the first and second mounting plates 30 and 60 that are positioned on the surface 22 of the stock 10 of the shoulder fired weapon. Third mounting plate 90 is defined by longitudinal edges 92 and 94, and ends 96 and 98. Third mounting plate 90 has two circular apertures 100 and 102 located proximate the ends 96 and 98 of the third mounting plate 90. These apertures are for the receipt of posts as more fully described hereafter. Each of these apertures is associated with a set screw bore 104 and 106 for securing the post. Additionally, there are a plurality of apertures 108 on the longitudinal center line of third mounting plate 90 which are utilized for a threaded fastener in order to secure third mounting plate 90 to the undersurface 20 of the comb 18.

Figure 9:
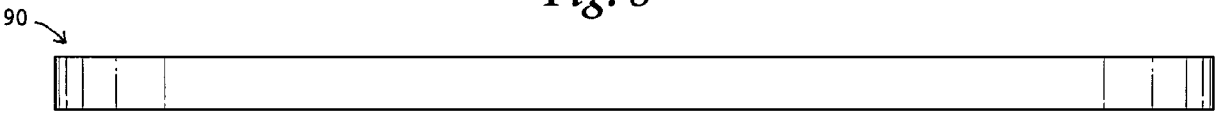
FIG. 9 is a side view of the third mounting plate secured to the lower surface of the comb.
Figure 10:
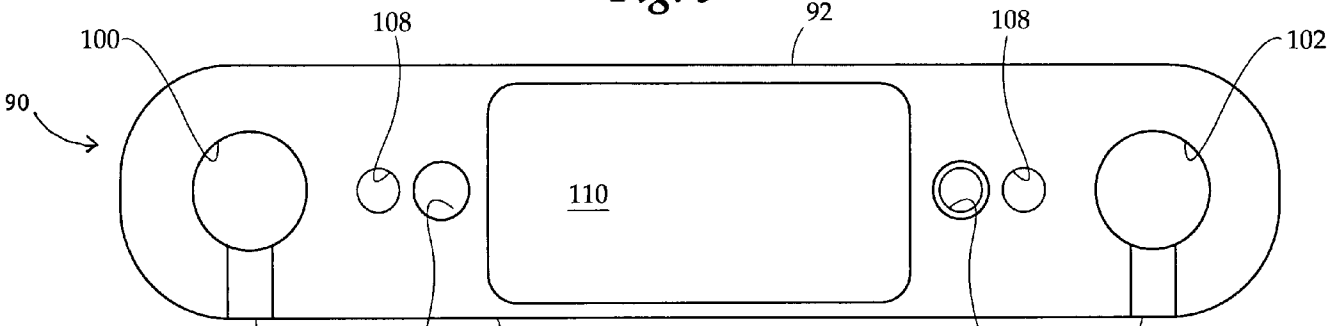
FIG. 10 is a bottom view of the third mounting plate secured to the lower surface of the comb.

FIG. 9 is a side view of the third mounting plate 90 and FIG. 10 is a bottom view of the third mounting plate 90. From FIG. 10 of the third mounting plate 90 it can be seen that there is a rectangular recess 110 formed in the bottom surface of the third mounting plate 90. This recess 110 provides additional space for the biasing means in that the recess 110 is in alignment with the aperture 74 formed in second mounting plate 60 for the receipt of the biasing means.

Figure 11:
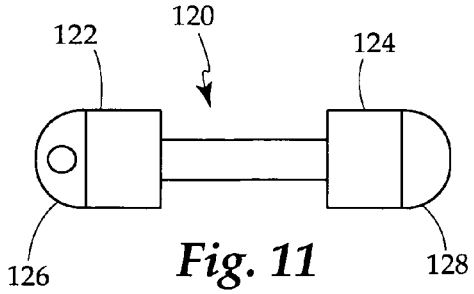
FIG. 11 is a top planar view of the biasing means of the present invention.
Figure 12:
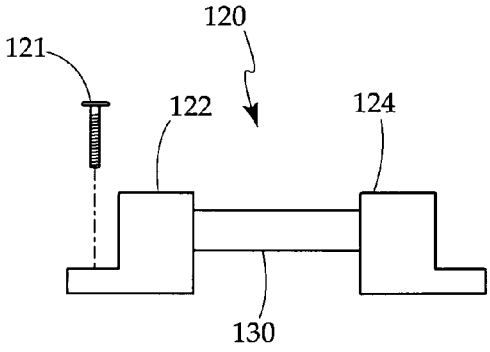
FIG. 12 is a side view of FIG. 1 of the biasing means of the present invention.
Figure 13:
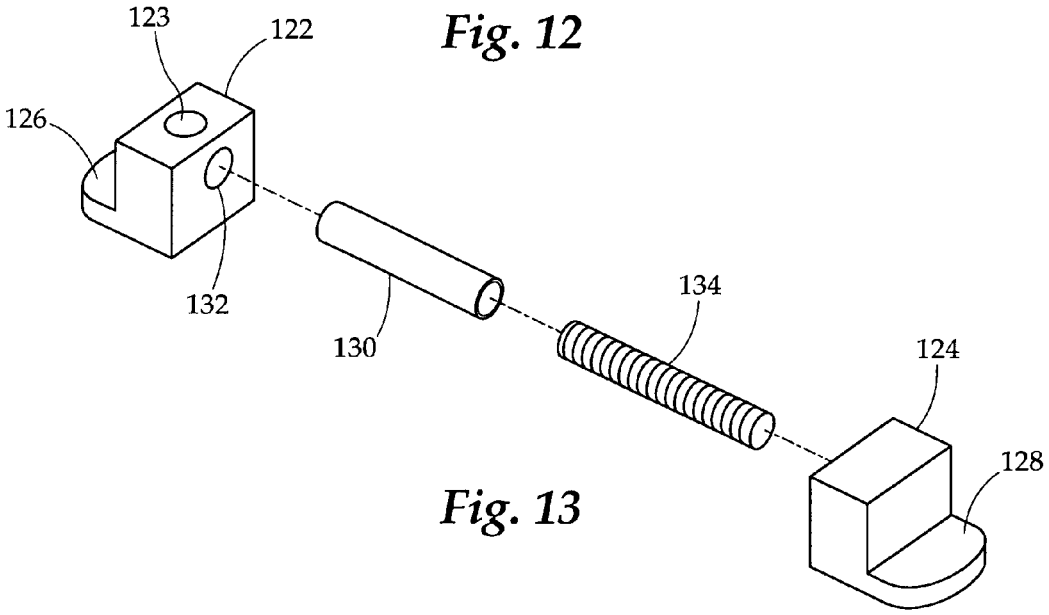
FIG. 13 is an exploded view of the biasing mechanism of the present invention.

FIGS. 11, 12, and 13 relate to the biasing means. FIG. 11 is a top view, FIG. 12 is a side view, and FIG. 13 is an exploded view of the biasing means which is designed to be positioned into longitudinal slot 74 on second mounting plate 60 (see FIG. 6). The biasing means 120 is comprised of a first end unit 122 and a second end unit 124. These end units are dimensioned and shaped to fit within slot 74 of second mounting plate 60 and to conform to the ends of the slot 74. Both biasing end pieces 122 and 124 have flattened steps 126 and 128 at their ends with flattened step 126 of first end member 122 having an aperture there through for receipt of a threaded fastener 121 thereby securing biasing means 120 to the underlying first mounting plate 30. Extending between the end mounting elements 122 and 124 of biasing means 120 is a tubular member 130 which is press fit into bores 132 and 134 (not shown) in the end members. Slidably receivable within tubular member 130 is a spring member 134 which extend through tubular member 130 and is engageable in the bores 132 and 134 of biasing end members 122 and 124. The spring member can be fabricated to any desired tension and compression which is comfortable for the particular shooter. Additionally, the tension and compression of any particular spring member 134 may be adjusted by positioning a set screw 123 into the bore of either end unit 122 and 124 which set screw can be adjusted to affect the compression of spring member 134 within tubular member 130.

In this configuration, the biasing member 120 is positioned within slot 74 of second mounting plate 60 and is secured to the underlying first mounting plate 30. This allows second mounting plate 60 which is secured to posts as described hereafter which posts are secured to the third mounting plate, to slidably move within slot 40 of first mounting plate 30. Thus the recoil of the weapon will cause the stock and first mounting plate 30 to recoil against the shoulder of the shooter, but the biasing means 120 will maintain the second mounting plate 60 and its attachment to the comb 18 as more particularly described hereafter, to remain isolated from the recoil and not cause any recoil affect to the cheek of the shooter which is pressed against the comb 18.

Figure 15:
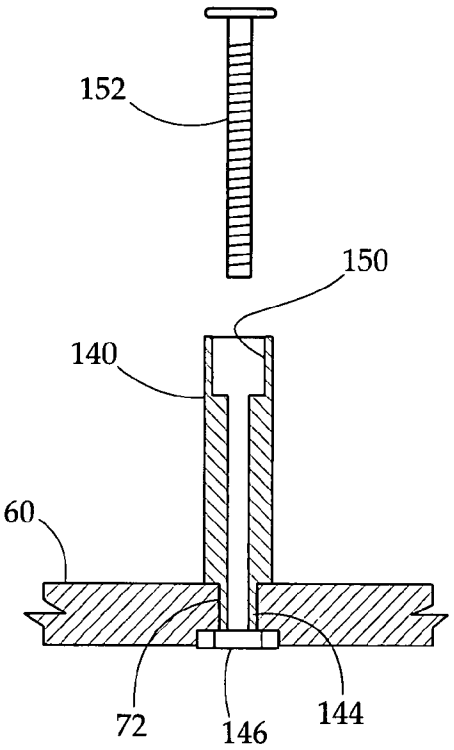
FIG. 15 is a side cutaway view of the post used to secure the comb to the stock.
Figure 14:
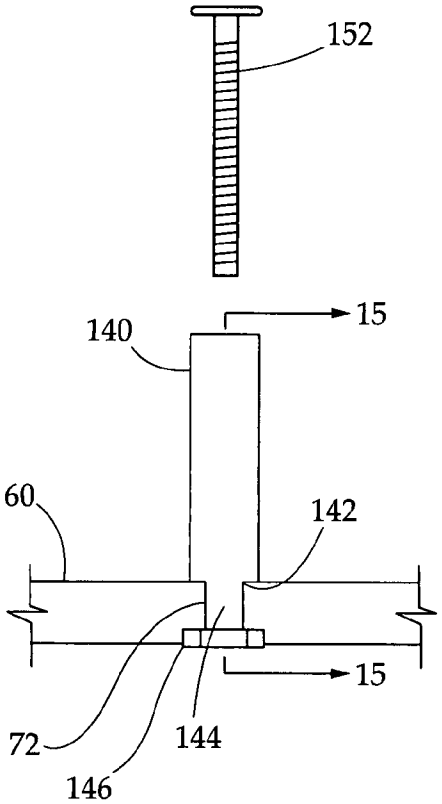
FIG. 14 is a side view of a mounting post used to secure the comb to the stock.

FIG. 14 is a side view of a post 140 mounted to second mounting plate 60. Post 140 is tubular and is stepped 142 at its lower end 144. The stepped lower end 144 is designed to extend through either slot 70 or 72 in second mounting plate 60 and to engage a locking nut 146 positioned in the bottom countersunk portion of slots 70 or 72. Post 140 has a stepped bore 150 as illustrated in FIG. 15 which is a cross sectional view of the post 140 along Plane 15-15 of FIG. 14. The stepped bore 150 allows for the insertion of a threaded fastener 152 into the bore and to be recessed within the bore and to engage the locking nut 146. The loosening and tightening of the threaded fastener 152 allows for post 140 to be slidably positioned within slots 72 and 74 thus moving the comb 18 to the left or to the right to accommodate the physiological aspects of the cheek of the shooter.

Figure 16:
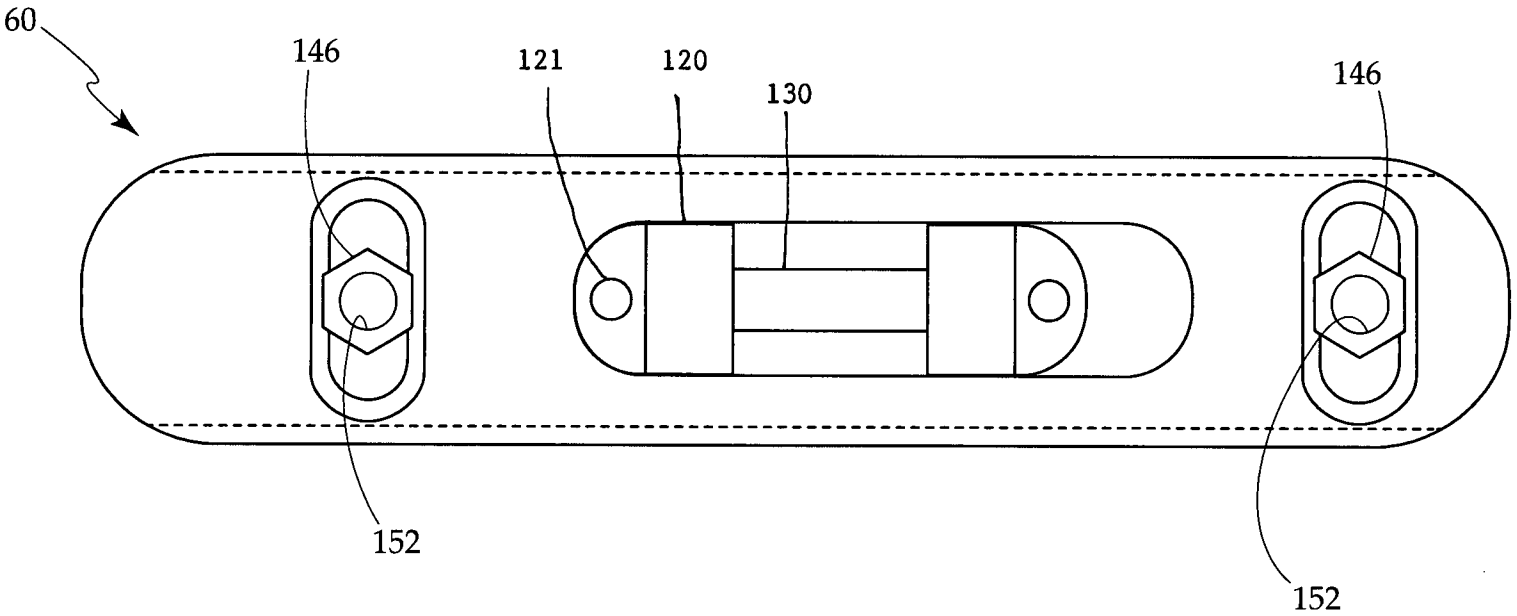
FIG. 16 is a bottom view of the second mounting plate with the biasing means positioned therein including the mounting post securing nuts.

FIG. 16 is a bottom view of second mounting plate 60 as originally presented in FIG. 6. FIG. 16 illustrates from the bottom view, the positioning of the locking nuts 146 to receive and align with the stepped lower end 144 of post 140 and to receive the threaded fastener 152 through the stepped bore 150. By loosening and tightening the threaded fastener 152 from above, the post 140 can be slid to the left or to the right. The upper portion of post 140 is engaged in the apertures 100 or 102 in third mounting plate 90 which is secured to the underside surface 20 of comb 18. The set screws 102 and 104 as illustrated in FIG. 8, secure post 140 once the appropriate left/right adjustments have been made to accommodate the cheek of the shooter.

FIG. 17 is an exploded view of a shotgun stock 10 and comb 18 illustrating the various positioning of the elements heretofore described and having their same reference numerals attached thereto which illustrates the manner in which the comb 18 is secured to the stock 10 to the various mounting plates and how the comb 18 is isolated from the recoil of the weapon because of the positioning of the biasing means 120 into slot 74 of second mounting plate 60, which thereby protects the cheek of the shooter during the recoil of the shoulder fired weapon.

In the description of Applicant's improved comb and mounting system, various elements including the mounting plates and slots have been referred to or illustrated with rounded ends. The rounded end is the aesthetically preferred shape primarily because of the amount of money associated with the stock and the exotic woods utilized in its construction. However, it will be recognize one of ordinary skill in the art that the rounded edges where mentioned, can be eliminated and the various mounting plates and their slots may be rectangular in end shape and not depart from the spirit and scope of the invention, nor the actual mounting and operation of Applicant's improved comb and mounting assembly.

The cost of the stock of a shoulder fired weapon, together with its aesthetic beauty would normally lead the owner/user to fabricate the comb and mount the comb from the portion of the stock that was removed, thus having a matching grain within the comb and the remaining stock. However, there may be a situation in which the owner/user desires a greater degree of comfort. In that instance, the comb could be a substitute comb comprised of a polymer core overlaid with a shock absorbing foam and then fitted within a resilient flexible sheath. This cushioned substitute comb could be mounted to the shoulder fired weapon utilizing the same brackets and in the same manner as heretofore discussed. The substitute polymer comb would be configured in the same manner as the comb removed from the actual stock. The substitute comb would merely provide the owner/user with a greater degree of comfort.

Therefore, while the present invention has been disclosed with respect to the preferred embodiments thereof, it will be recognized by those of ordinary skill in the art that various changes and modifications can be made without departing from the spirit and scope of the invention. It is therefore manifestly intended that the invention be limited only by the claims and the equivalence thereof.

I claim:

1. An improved comb and mounting system for a shoulder fired weapon isolating the comb from the recoil of the shoulder fired weapon wherein said comb is a removed section of stock from the shoulder fired weapon resulting in a comb removed area of said stock of said shoulder fired weapon, said improved comb and mounting system comprising:

a comb member having an inwardly angled front surface, an inwardly angled rear surface, and a planar lower surface;

a first bracket member secured to said comb removed area of said stock, said first bracket member defining a slot;

a second bracket member slidably receivable into said slot member of said first bracket member, said second bracket having a centrally disposed elongated longitudinal aperture and two elongated apertures perpendicularly disposed between longitudinal edges and proximate the ends of said second bracket member;

an adjustable biasing component disposed within said longitudinal elongated slot member of said second bracket member, wherein said adjustable biasing component comprises a first and second end member, said first and second end members disposed in said elongated longitudinal aperture of said second bracket member at the ends of said elongated longitudinal aperture, each of said end members having a horizontal bore in alignment with each other, a tubular member press fit into said complimentary bores of said end members, said tubular member having positioned therein, a biasing component in the form of a spring, said end members secured to said first bracket member, one of said end members having a set screw bore for adjusting said biasing component tension;

two adjustable upstanding posts slidably securable and adjustable between said longitudinal edges of said second bracket member within said longitudinal slots perpendicularly disposed between said longitudinal edges of said second bracket member, and securable thereto;

a third bracket member secured to said planar lower surface of said comb member, said third bracket member complimentary in shape to said second bracket member and having complimentary bores for receipt of said upstanding posts of said second bracket member.

2. The improved comb and mounting system for a shoulder fired weapon in accordance with claim 1 wherein said comb member inwardly angled front surface is trimmed to define a gap between said inwardly angled front surface and a complimentary outwardly angled surface of said comb removed area of said stock of said shoulder fired weapon.

3. The improved comb and mounting system for a shoulder fired weapon in accordance with claim 1 wherein said two elongated apertures perpendicularly disposed between said longitudinal edges and proximate the ends of said second bracket member are countersunk from an underside of said second bracket member, said countersunk area of said second bracket member for receipt of threaded nuts cooperative with a threaded bolt disposed through said adjustable upstanding posts to secure said posts in a vertical orientation with respect to said second bracket member and for adjustment of said posts and said comb member laterally with respect to said removed section of said stock of said shoulder fired weapon.

4. The improved comb and mounting system for a shoulder fired weapon in accordance with claim 1 wherein said bores of said third bracket member have horizontal set screw bores and set screws associated therewith for adjustment of height of said comb member above the said comb removed area of said stock of said shoulder fired weapon.

5. An improved comb and mounting system for a shoulder fired weapon generating recoil, the improved comb and mounting system comprising:

a comb member cut from the upper surface of a stock of a shoulder fired weapon, said comb member having an inwardly angled front surface, an inwardly angled rear surface, and a planar lower surface, said angled front surface being trimmed to define a gap between said inwardly angled front surface and a complimentary outwardly angled front surface of a comb removed area of said stock of said shoulder fired weapon;

a first bracket member secured to said comb removed area of said stock of said shoulder fired weapon, said first bracket member defined by a planar base, longitudinal side walls, and an inwardly bending flange on each of said side walls thereby defining a slot member;

a second bracket member slidably receivable into said slot member of said first bracket member, said second bracket member generally rectangularly complimentary to said first bracket having longitudinal edges, a top surface, and an undersurface, said second bracket member having a centrally disposed elongated aperture and two elongated apertures perpendicularly disposed between the said longitudinal edges and proximate said ends of said second bracket member, said longitudinal slot members disposed perpendicular to said edges of said second bracket member being countersunk from said undersurface of said second bracket member;

an adjustable biasing component disposed within said longitudinal slot member of said second bracket member, wherein said adjustable biasing component comprises a first and second end member, said first and second end members disposed in said elongated longitudinal aperture of said second bracket member at the ends of said elongated longitudinal aperture, each of said end members having a horizontal bore in alignment with each other, a tubular member press fit into said complimentary bores of said end members, said tubular member having positioned therein, a biasing component in the form of a spring, said end members secured to said first bracket member, one of said end members having a set screw bore for adjusting said biasing component tension;

two adjustable upstanding posts slidably secured and adjustable between said longitudinal edges of said second bracket member within said longitudinal slots perpendicularly disposed between said longitudinal edges of said second bracket member and securable thereto;

a third bracket member secured to said planar lower surface of said comb member, said third bracket member generally rectangular in shape and complimentary with said second bracket member, said third bracket member having bores positioned proximate the ends thereof, for receipt of said upstanding posts of said second bracket member, said bores having a set screw associated therewith for adjusting the height of the comb member above said first and second bracket members and said stock of said shoulder fired weapon.

6. The improved comb and mounting system for a shoulder fired weapon in accordance with claim 5 wherein said comb member inwardly angled front surface is trimmed to define a gap between said inwardly angled front surface and a complimentary outwardly angled surface of said comb removed area of said stock of said shoulder fired weapon.

7. The improved comb and mounting system for a shoulder fired weapon in accordance with claim 5 wherein said two elongated apertures perpendicularly disposed between said longitudinal edges and proximate the ends of said second bracket member are countersunk from an underside of said second bracket member, said countersunk area of said second bracket member for receipt of threaded nuts cooperative with a threaded bolt disposed through said adjustable upstanding posts to secure said posts in a vertical orientation with respect to said second bracket member and for adjustment of said posts and said comb member laterally with respect to said removed section of said stock of said shoulder fired weapon.

8. The improved comb and mounting system for a shoulder fired weapon in accordance with claim 5 wherein said bores of said third bracket member have horizontal set screw bores and set screws associated therewith for adjustment of height of said comb member above the said comb removed area of said stock of said shoulder fired weapon.

9. A mounting system for isolating the comb of a shoulder fired weapon from the recoil of said shoulder fired weapon, the comb conforming to a portion of the stock of said shoulder fired weapon, which is removed from said stock resulting in said comb and a comb removed area of said stock of said shoulder fired weapon, said mounting system comprising:

a first bracket member secured to said comb removed area of said stock of said shoulder fired weapon, said first bracket member defined by a planar base, longitudinal side walls, and an inwardly bending flange on each of said side walls thereby defining a slot member;

a second bracket member slidably receivable into said slot member of said first bracket member, said second bracket member generally rectangularly complimentary to said first bracket having longitudinal edges, a top surface, and an undersurface, said second bracket member having a centrally disposed elongated aperture and two elongated apertures perpendicularly disposed between the said longitudinal edges and proximate said ends of said second bracket member, said longitudinal slot members disposed perpendicular to said edges of said second bracket member being countersunk from said undersurface of said second bracket member;

an adjustable biasing component disposed within said longitudinal slot member of said second bracket member, wherein said adjustable biasing component comprises a first and second end member, said first and second end members disposed in said elongated longitudinal aperture of said second bracket member at the ends of said elongated longitudinal aperture, each of said end members having a horizontal bore in alignment with each other, a tubular member press fit into said complimentary bores of said end members, said tubular member having positioned therein, a biasing component in the form of a spring, said end members secured to said first bracket member, one of said end members having a set screw bore for adjusting said biasing component tension;

two adjustable upstanding posts slidably secured and adjustable between said longitudinal edges of said second bracket member within said longitudinal slots perpendicularly disposed between said longitudinal edges of said second bracket member and securable thereto;

a third bracket member secured to said planar lower surface of said comb member, said third bracket member generally rectangular in shape and complimentary with said second bracket member, said third bracket member having bores positioned proximate the ends thereof, for receipt of said upstanding posts of said second bracket member, said bores having a set screw associated therewith for adjusting the height of the comb member above said first and second bracket members and said stock of said shoulder fired weapon.

10. The improved comb and mounting system for a shoulder fired weapon in accordance with claim 9 wherein said comb member inwardly angled front surface is trimmed to define a gap between said inwardly angled front surface and a complimentary outwardly angled surface of said comb removed area of said stock of said shoulder fired weapon.

11. The improved comb and mounting system for a shoulder fired weapon in accordance with claim 10 wherein said comb conforming to a portion of said stock of said shoulder fired weapon comprises the removed section of said stock of said shoulder fired weapon.

12. The improved comb and mounting system for a shoulder fired weapon in accordance with claim 10 wherein said comb conforming to a portion of said stock of said shoulder fired weapon which is removed from said stock comprises a polymer core overlaid with a shock absorbing foam and fitted within a resilient flexible sheath which is secured to said stock of said shoulder fired weapon.

13. The improved comb and mounting system for a shoulder fired weapon in accordance with claim 9 wherein said two elongated apertures perpendicularly disposed between said longitudinal edges and proximate the ends of said second bracket member are countersunk from an underside of said second bracket member, said countersunk area of said second bracket member for receipt of threaded nuts cooperative with a threaded bolt disposed through said adjustable upstanding posts to secure said posts in a vertical orientation with respect to said second bracket member and for adjustment of said posts and said comb member laterally with respect to said removed section of said stock of said shoulder fired weapon.

14. The improved comb and mounting system for a shoulder fired weapon in accordance with claim 9 wherein said bores of said third bracket member have horizontal set screw bores and set screws associated therewith for adjustment of height of said comb member above the said comb removed area of said stock of said shoulder fired weapon.

* * * * *